United States Patent [19]

Takayama et al.

[11] Patent Number: 4,560,899

[45] Date of Patent: Dec. 24, 1985

[54] ELECTRON BEAM FOCUSING LENS

[75] Inventors: Shigehiko Takayama, Mitaka; Masanori Maruyama, Kokubunji; Masakazu Fukushima, Tokyo, all of Japan

[73] Assignee: Hitachi, Ltd., Tokyo, Japan

[21] Appl. No.: 449,198

[22] Filed: Dec. 13, 1982

[30] Foreign Application Priority Data

Dec. 16, 1981 [JP] Japan ..... 56-201614

[51] Int. Cl.[4] ..... H01J 29/00; H01J 31/26

[52] U.S. Cl. ..... 313/449; 313/382; 313/383; 313/458

[58] Field of Search ..... 313/382, 389, 449, 458, 313/441, 414, 383

[56] References Cited

U.S. PATENT DOCUMENTS 3,193,721 7/1965 Nakayama et al. ..... 313/382 X 4,268,777 5/1981 Van Roosmalen ..... 313/389 X

FOREIGN PATENT DOCUMENTS 55-121254 9/1980 Japan ..... 313/449

*Primary Examiner*—David K. Moore
*Assistant Examiner*—K. Wieder
*Attorney, Agent, or Firm*—Antonelli, Terry & Wands

[57] ABSTRACT

An electron beam focusing lens comprises at least two cylindrical electrodes one of which is to be applied with a high potential and the other of which is to be applied with a low potential. A plate electrode having an aperture at a central portion thereof is provided at an end face of the high-potential cylindrical electrode opposite to the low-potential cylindrical electrode. The plate electrode may be of a circularly curved shape which is projected toward the low-potential cylindrical electrode between the outer and inner circumference of the plate electrode.

9 Claims, 13 Drawing Figures

ELECTRON BEAM FOCUSING LENS

The present invention relates to an electron beam focusing lens for forming an electrostatic focusing field to focus an electron beam, and more particularly to an electrostatic focusing lens suitable for use in an image pickup tube, a cathode-ray tube or the like.

For easy understanding of an electron beam focusing lens, an image pickup tube provided with a conventional focusing lens of this kind will be explained with reference to FIG. 1, by way of example.

In an image pickup tube of electrostatic focusing type, a photoconductive film is scanned, by an electron beam which is focused by a focusing lens, to convert an optical signal into an electrical signal. Accordingly, the resolution of the image pickup tube is mainly determined by the spot diameter of the focused electron beam.

An electron gun in the image pickup tube of electrostatic focusing type generally includes two fundamental parts, that is, an electron beam generating portion and an electron beam focusing lens (namely, a main lens). FIG. 1 shows in cross section an image pick-up tube of electrostatic focusing type. In FIG. 1, reference numeral 1 designates an evacuated envelope, 2 a cathode, 3 a grid and 4 an anode. The cathode 2, grid 3 and anode 4 make up a triode section 14 which is the electron beam generating portion. Reference numerals 5, 6 and 7 designate cylindrical electrodes which form the electron focusing lens (namely, main lens), 9 a mesh electrode for forming a main lens portion 15 together with the electrodes 5, 6 and 7, 10 a photoconductive film, and 13 a deflection coil disposed outside the image pickup tube. An electron beam emitted from the cathode 2 is focused by a lens formed at the triode section 14 to form a cross-over point, and then passes through a beam-limiting aperture 8 provided in the anode 4. The electron beam having passed through the aperture 8 is focused by the focusing lens or main lens made up of the electrodes 5, 6 and 7, as indicated by an electron trajectory 11. At the same time, the electron beam is deflected, as indicated by a trajectory 12, due to a magnetic field generated by the deflection coil 13 to scan the photoconductive film 10. Further, the deflected electron beam impinges vertically upon the photoconductive film 10 by the action of a collimation lens formed by the electrode 7 and the mesh electrode 9. Usually, the electrode 5 and the mesh electrode 9 are electrically connected to each other and are applied with a high potential, for example, about 1400 V. The electrode 6 is applied with a low potential, for example, about 250 V, and the electrode 7 is applied with a potential (for example, about 770 V) which is intermediate between the potentials of the electrodes 6 and 9. Accordingly, in a general image pickup tube of electrostatic focusing type, the electrodes 5, 6, 7 and 9 form a uni-potential focusing lens, and the electron beam having passed through the beam-limiting aperture 8 is focused mainly by the main lens formed by the electrodes 5, 6 and 7, to form a substantially minimum spot on the photoconductive film 10.

A uni-potential focusing type and a bi-potential focusing type have been widely used as the electron beam focusing lens in an image pickup tube. FIG. 2*a* shows the cross section of a typical uni-potential focusing lens while illustrating an axial potential distribution $\phi$ in the axial direction and the distribution of the second derivative $\phi''$ of the axial potential with respect to the position in the axial direction. FIG. 2*b* shows the cross section of a typical bi-potential focusing lens while illustrating an axial potential distribution $\phi$ in the axial direction and the distribution of the second derivative $\phi''$ of the axial potential with respect to the position in the axial direction. The second derivative distribution $\phi''$ has a close relationship with the focusing action of the lens. The resolution of an image pickup tube, a cathode-ray tube or the like is mainly determined by the spot diameter of the focused electron beam. In order to make small the beam spot diameter, it is required to make the spherical aberration of the focusing lens or main lens as small as possible.

However, conventional electrostatic lenses used as the focusing lens in an electron gun involve large spherical aberration. In order to reduce the spherical aberration, an EFL (extended field lens) has been proposed which is based upon the concept that the spherical aberration can be reduced by causing an axial potential distribution to have a gentle slope while making the second derivative of axial potential as small as possible in a region where the axial potential has small values. See Japanese Patent Application Laid-Open No. 76072/76. FIG. 3 shows the cross section of an EFL while illustrating an axial potential distribution $\phi$ and the distribution of the second derivative $\phi''$ of the axial potential. As shown in FIG. 3, the EFL has a structure that at least three cylindrical electrodes (four cylindrical electrodes in FIG. 3) are arranged face to face with each other.

An object of the present invention is to provide an electron beam focusing lens in which the spherical aberration is further reduced, thereby improving the characteristics of beam spot.

The minimum spot of a focused electron beam has a definite diameter which is dependent on the spherical aberration of a focusing lens used (hereinafter referred to as "the diameter of circle of least confusion"). The radius of the minimum beam spot is given by $\frac{1}{4}MC_s\alpha^3$, where M indicates a lateral magnification, $C_s$ a spherical aberation coefficient, and $\alpha$ an incident angle of electron beam. Accordingly, the diameter $D_c$ of circle of least confusion is given by the following equation:

$$D_c=\tfrac{1}{2}MC_s\alpha^3$$

As is apparent from the equation (1), the beam spot diameter decreases as the spherical aberration coefficient $C_s$ is smaller. Further, the spherical aberration coefficient $C_s$ is given by the following equation:

$$C_s = \frac{1}{64\sqrt{\phi_0}} \int_{Z_o}^{Z_1} \sqrt{\phi}\,[4S'^4 + 3S^4 - 5S^2S' - SS'']H^4(Z)dZ \qquad (2)$$

where S indicates a ratio $\phi'(Z)/\phi(Z)$, $\phi(Z)$ an axial potential (namely, an electric potential on the lens axis), Z a coordinate in the axial direction, $Z_o$ the position of an entrance of the lens, $Z_1$ the position of an exit of the lens, ['] the differentiation with respect to Z, and H(Z) the distance of an electron trajectory from the lens axis in each coordinate Z. Initial conditions $H(Z_o)=0$ and $H'(Z_o)=1$ are assumed. The present invention is based upon the fact that the spherical aberration of an electrostatic focusing lens can be reduced by causing an axial potential distribution to have a gentle slope on the low potential side and a steep slope on the high potential side. Thus, in an electron beam focusing lens according to the present invention, a plate electrode having an aperture is provided at an end face of a high-potential electrode opposite to a low-potential electrode, thereby suppressing the penetration of an electric potential from the low-potential electrode into the high-potential electrode to make the slope of the axial potential distribution on the high potential side steeper than that on the low potential side. The plate electrode may have a circularly curved portion projected toward the low-potential electrode to further reduce the spherical aberration.

The present invention will be apparent from the following detailed description taken in conjunction with the accompanying drawings, in which:

FIG. 1 is a sectional view showing a conventional image pickup tube of electrostatic focusing type;

FIG. 2*a* shows the cross section of a uni-potential focusing lens while illustrating an axial potential distribution and the distribution of the second derivative of the axial potential;

FIG. 2*b* shows the cross section of a bi-potential focusing lens while illustrating an axial potential distribution and the distribution of the second derivative of the axial potential;

Figure 10:
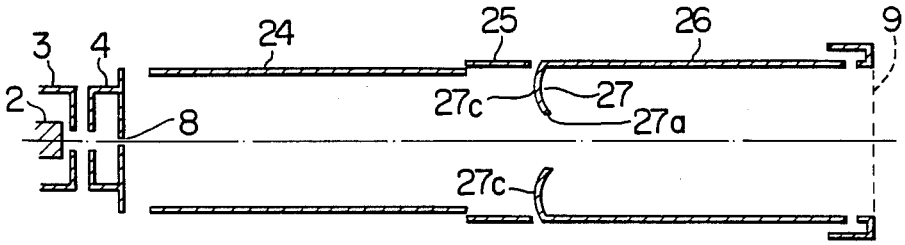
FIG. 10 is a sectional view showing the electrode structure of an image pickup tube provided with a focusing lens according to a still further embodiment of the present invention.
Figure 12:
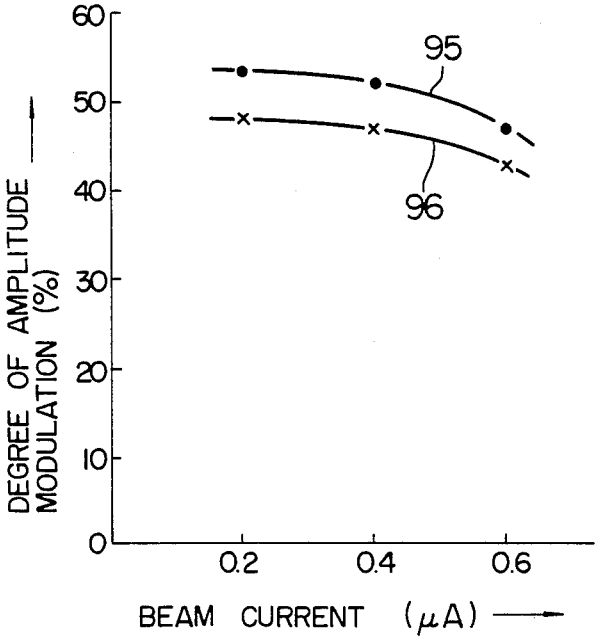
Figure 11:
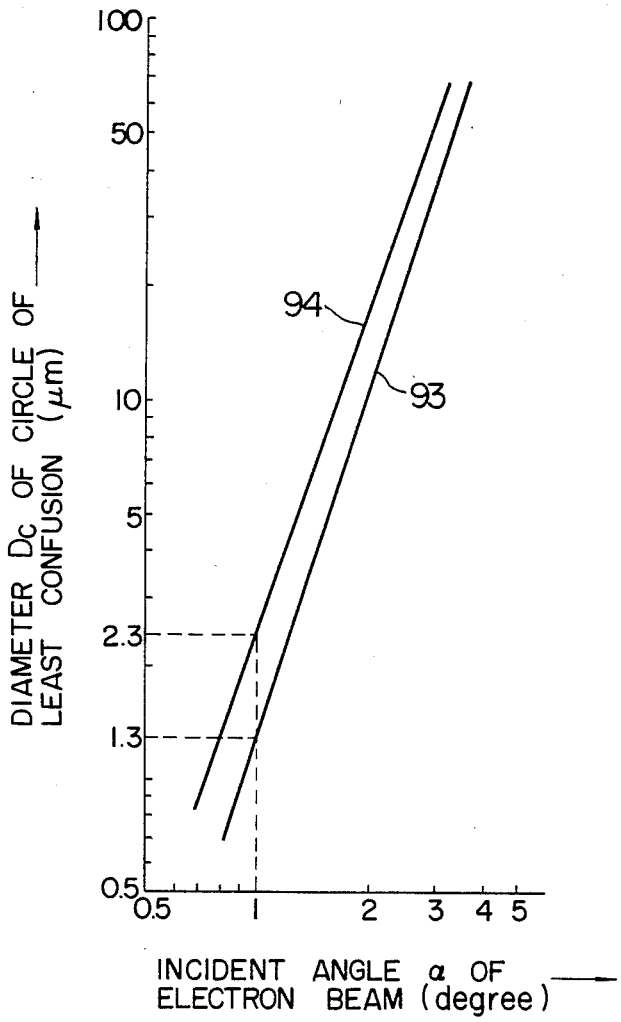

FIG. 11 is a graph showing a relation between the incident angle of electron beam and the diameter of circle of least confusion for each of the image pickup tube shown in FIG. 10 and a conventional image pickup tube; and FIG. 12 is a graph showing a relation between a beam current and the degree of amplitude modulation for each of the image pickup tube shown in FIG. 10 and the conventional image pickup tube.

Figure 4:
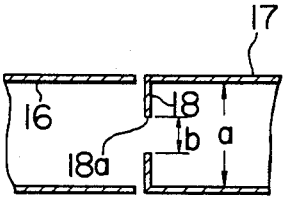
FIG. 4 is a sectional view showing a main part of a focusing lens according to an embodiment of the present invention provided with a flat plate electrode.

FIG. 4 is a sectional view showing a main part of a focusing lens provided with a flat plate or disc electrode according to an embodiment of the present invention. In FIG. 4, reference numeral 16 designates a cylindrical electrode applied with a low potential, 17 a cylindrical electrode applied with a high potential, and 18 a flat plate electrode. The plate electrode 18 is provided at an end face of the high-potential electrode 17 opposite to the low-potential electrode 16 and is provided with an aperture 18*a* of a diameter b in a central portion thereof.

Figure 2A:
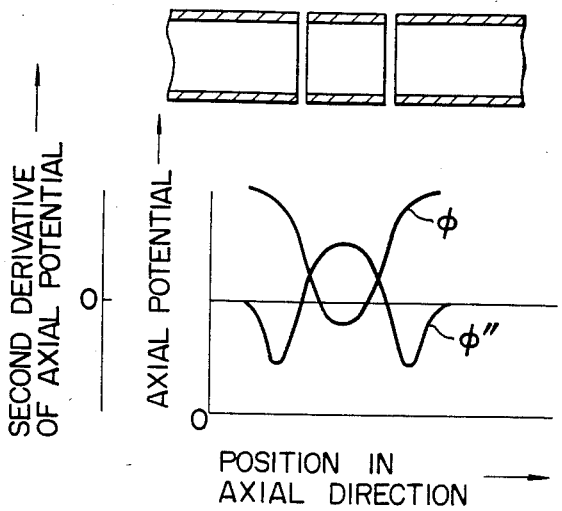
FIG. 2a PRIOR ART
Figure 2B:
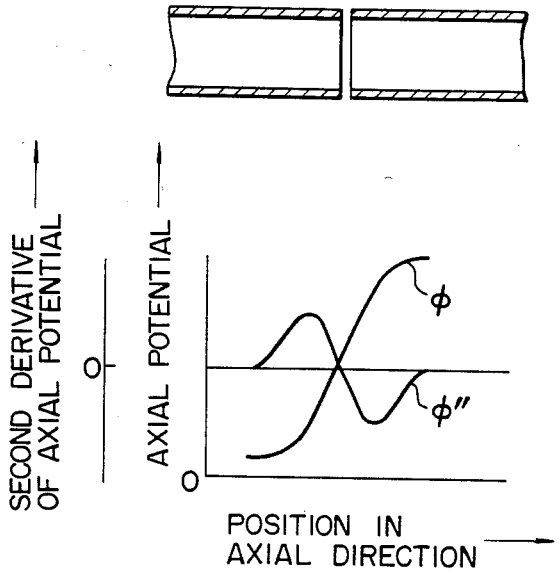
FIG. 2b PRIOR ART
Figure 3:
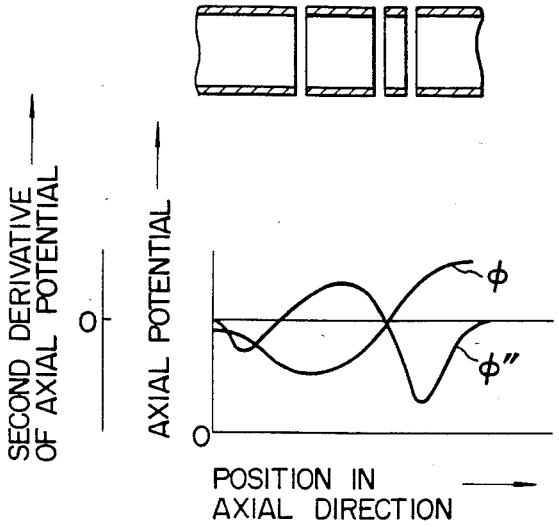
FIG. 3 PRIOR ART
FIG. 3 shows the cross section of an EFL extended field lens while illustrating an axial potential distribution and the distribution of the second derivative of the axial potential.

The spherical aberration coefficient $C_s$ of the focusing lens having the above-mentioned structure has been calculated from the equation (2), and it has been found that, when a ratio of the aperture diameter b of the plate electrode 18 to the inner diameter a of the high-potential cylindrical electrode 17 is equal to or less than 0.8, the spherical aberration coefficient $C_s$ of this focusing lens is smaller than that of the conventional bi-potential focusing lens shown in FIG. 2*b* in which two cylindrical electrodes having the same inner diameter are arranged face to face with each other. Further, it is preferable to make the diameter b of the aperture 18*a* equal to or larger than one-tenth of the inner diameter a of the cylindrical electrode 17 so that an electron beam is not interrupted by the plate electrode 18.

Figure 5:
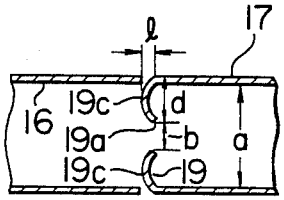
FIG. 5 is a sectional view showing a main part of a focusing lens according to another embodiment of the present invention provided with a plate electrode having a circularly curved portion.

FIG. 5 is a sectional view showing a main part of a focusing lens provided with a plate electrode having a circularly curved portion according to another embodiment of the present invention. Referring to FIG. 5, a plate electrode 19 provided at an end face of a high-potential electrode 17 opposite to a low-potential electrode 16 has a circularly curved portion which is projected toward the low-potential electrode 16 between the outer circumference of the plate electrode 19 and the edge of an aperture 19*a* or the inner circumference of the plate electrode 19. A peak of the projection of the curve portion is positioned substantially at the middle between the outer and inner circumferences of the plate electrode 19.

In more detail, the plate electrode 19 has the aperture 19*a* at its central portion. The height or projection length of the curved portion in a direction of the lens axis increases with an increased distance from the outer circumference of the plate electrode 19 toward the center axis of the aperture or the lens axis until it reaches the maximum value at 19*c*, and then decreases with a further increased distance from the outer circumference of the plate electrode 19 until it takes the minimum value at the edge of the aperture 19*a* or the inner circumference of the plate electrode 19 which is in the same level as the outer circumference of the plate electrode 19. In other words, the plate electrode 19 has the form of an annular ring formed in such a manner that a circular arc which is convex toward the low-potential electrode 16 between the outer and inner circumferences of the electrode 19 is rotated about the center axis of the aperture 19*a*.

In FIG. 5, reference character l designates the maximum height at the peak position 19*c*, and d a distance in a radial direction between the outer circumference of the plate electrode 19 and the inner circumference thereof or the edge of the aperture 19*a*. Like the FIG. 4 embodiment, it is preferable to make the diameter b of the aperture 19*a* equal to or smaller than eight-tenths of the inner diameter a of the high-potential cylindrical electrode 17 but larger than a certain value so that an electron beam is not interrupted by the plate electrode 19. This holds for the following embodiments.

Figure 6:
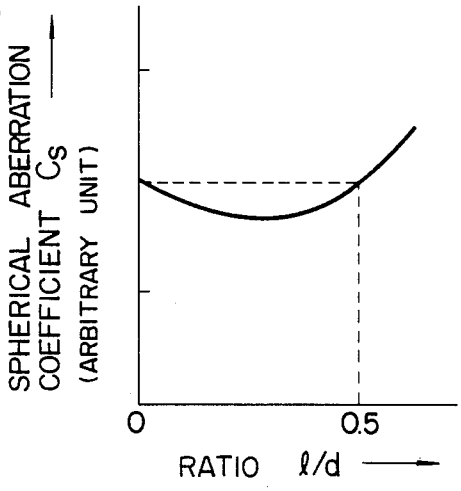
FIG. 6 is a graph showing a relation between a spherical aberration coefficient and a ratio of the maximum height of a curved portion of the plate electrode to a distance between the outer and inner circumferences of the plate electrode for the focusing lens of FIG. 5.

The spherical aberration coefficient $C_s$ of the focusing lens having the structure shown in FIG. 5 has been calculated from the equation (2), for various values of the maximum height l of the curved portion of the plate electrode 19. FIG. 6 shows a relation between the calculated spherical aberration coefficient $C_s$ and a ratio l/d. As shown in FIG. 6, the spherical aberration coefficient $C_s$ is minimum when the ratio l/d has a value of 0.2 to 0.3. This minimum spherical aberration coefficient is about 16% smaller than the spherical aberration coefficient of the focusing lens shown in FIG. 4 which corresponds to the case of l=0 in the focusing lens of FIG. 5. FIG. 6 shows that the spherical aberration of the focusing lens shown in FIG. 5, if the ratio l/d is selected to be less than 0.5, can be made smaller than that of the focusing lens shown in FIG. 4. In the FIG. 5 embodiment, it is best that the ratio l/d is made 0.2 to 0.3.

Figure 7:
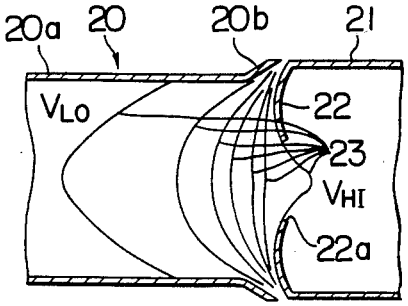
FIG. 7 shows in section a main part of a focusing lens according to a further embodiment of the present invention which is widely applicable to an electron gun.
Figure 8:
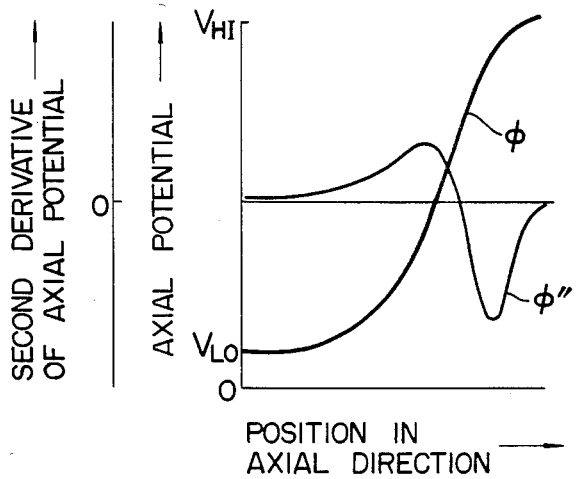
FIG. 8 shows an axial potential distribution and the distribution of the second derivative of the axial potential for the focusing lens of FIG. 7.

FIG. 7 shows, in section, a main part of an electron beam focusing lens according to a further embodiment of the present invention which is widely applicable to an electron gun. The focusing lens shown in FIG. 7 is made up of at least two cylindrical electrodes having a common axis, that is, an electrode 20 to be applied with a low-potential $V_{LO}$ and an electrode 21 to be applied with a high potential $V_{HI}$. The low-potential electrode 20 has a cylinder portion 20*a* and a truncated cone portion 20*b* whose inner diameter is maximum at an end opposite to the high-potential electrode 21. The high-potential electrode 21 is a cylinder having an inner diameter approximately equal to the maximum inner diameter of the truncated cone portion 20*b*, and a plate electrode 22 having a circularly curved portion projected toward the low-potential electrode 20 is provided at an end face of the high-potential electrode 21 opposite to the low-potential electrode 20. The plate electrode 22 is provided with an electron beam permeable aperture 22*a* at a central portion thereof. The shape of the plate electrode 22 is similar to that of the plate electrode 19 in FIG. 5. FIG. 7 also shows equipotential lines 23. FIG. 8 shows an axial potential distribution $\phi$ and the distribution of the second derivative $\phi''$ of the axial potential in the FIG. 7 embodiment. As is apparent from FIG. 8, the axial potential distribution $\phi$ monotonically increasing from the low potential $V_{LO}$ to the high potential $V_{HI}$ varies gently in a range where the second derivative distribution $\phi''$ has a positive gradient, but varies steeply in a range where $\phi''$ has a negative gradient.

Figure 9:
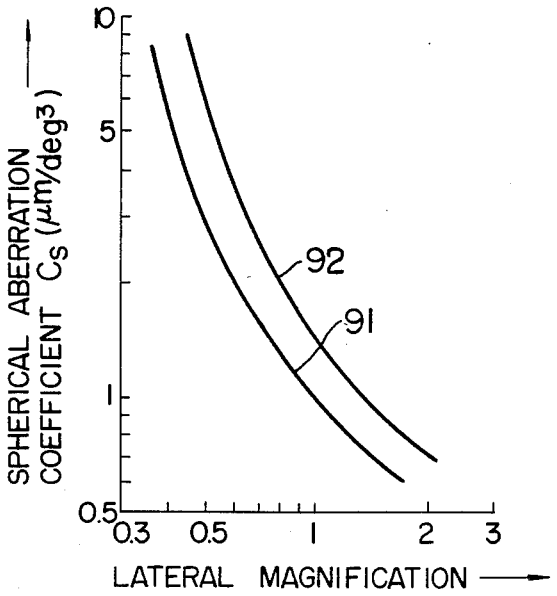
FIG. 9 is a graph showing a relation between lateral magnification and spherical aberration coefficient for each of the focusing lens of FIG. 7 and a conventional bi-potential focusing lens.

Preferred dimensions of the electrodes shown in FIG. 7 will now be exemplified. The cylinder portion 20*a* of the electrode 20 has an inner diameter of about 11 mm, and the truncated cone portion 20*b* thereof has an axial length of about 2 mm and the maximum inner diameter of about 12 mm. The cylinder electrode 21 has an inner diameter of about 12 mm. The aperture 22*a* of the plate electrode 22 has a diameter of about 4 mm, and the distance in a radial direction between the outer and inner circumferences of the plate electrode 22 is about 4 mm. A peak of the projection of the curved portion of the plate electrode 22 is positioned at the middle between the outer and inner circumferences of the plate electrode and distanced from the center axis of the aperture 22*a* by about 4 mm the height of the peak is about 1 mm. Accordingly, the peak of the curved portion is in a position distanced from the center axis of the aperture 22*a* by about 66% of the inner diameter of the high-potential electrode 21, the maximum height of the curved portion at the peak position is about 25% of the distance in a radial direction between the outer and inner circumferences of the plate electrode 22, and the diameter of the aperture 22*a* is about 33% of the inner diameter of the high-potential electrode 21. In the case where an electric potential applied to the electrode 20 is set to be about one-tenth of that applied to the electrode 21, the electron beam trajectory in the focusing lens shown in FIG. 7 has been calculated for various values of the lateral magnification M which are obtained by varying the position of an object point (namely, the starting point of electron beam) on the lens axis. By using the resultant diameter $D_c$ of circle of least confusion, the spherical aberration coefficient $C_s$ has been calculated from the equation (1). FIG. 9 shows the resulting relation 91 between the lateral magnification M and the spherical aberration coefficient $C_s$. For the sake of comparison, FIG. 9 also shows a similar relation 92 obtained when the same operating condition as the focusing lens of FIG. 7 is applied to the bi-potential lens of FIG. 2*b* as a typical one of conventional focusing lenses in which two cylindrical electrodes with the same inner diameter are arranged face to face with each other. As is apparent from FIG. 9, the focusing lens according to the present invention is far smaller in spherical aberration than the conventional bi-potential focusing lens.

Figure 1:
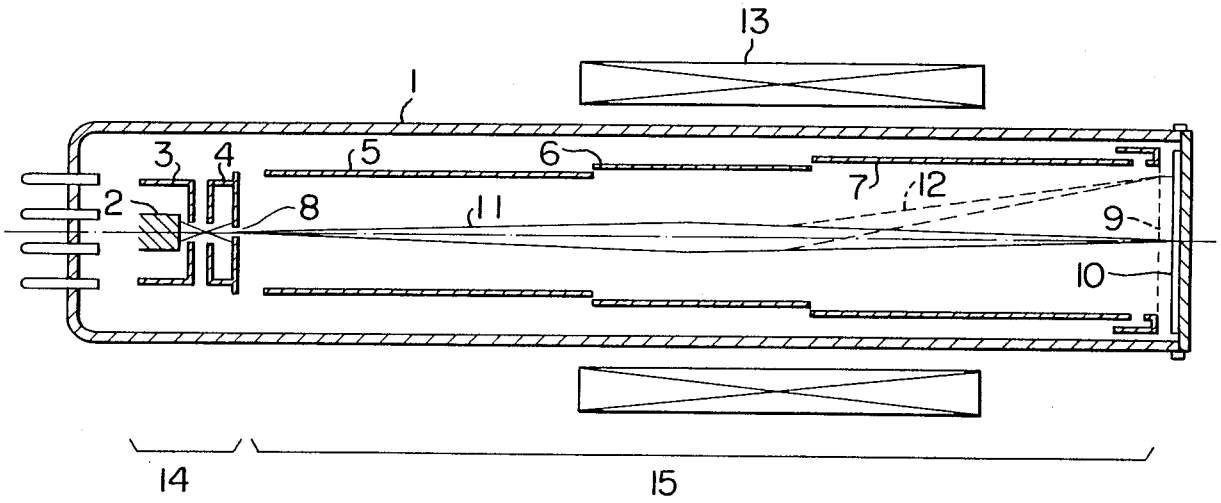
FIG. 1 PRIOR ART

FIG. 10 shows a still further embodiment of an electron beam focusing lens according to the present invention which forms the main lens portion of an image pickup tube. FIG. 10 is a sectional view showing the electrode structure of the image pickup tube. In FIG. 10, the same reference numerals as in FIG. 1 designate similar parts, and therefore explanation thereof will be omitted. The focusing lens according to the present embodiments includes three cylindrical electrodes 24, 25 and 26 arranged concentrically. The inner diameters of the electrodes 25 and 26 are substantially equal to each other and the inner diameter of the electrode 24 is slightly smaller than those of the electrodes 25 and 26. A plate electrode 27 is provided at an end face of the electrode 26 opposite to the electrode 25. The plate electrode 27 has an aperture 27*a* at its central portion and has a circularly curved portion which is projected toward the electrode 25. The electrodes 24, 25 and 26 form the main lens while the electrode 26 and a mesh electrode 9 form a collimation lens. The operation of an image pickup tube has been explained with reference to FIG. 1, and therefore such explanation will be omitted here. In a preferable operation of the electrode structure shown in FIG. 10, an electric potential applied to the electrode 24 is made nearly equal to 10% of that applied to the electrode 26 while the electrode 25 is applied with a potential which is intermediate between the potentials applied to the electrodes 24 and 26. For example, the electrodes 24, 25 and 26 are applied with about 90, 300 and 770 V, respectively, and the mesh electrode 9 is applied with 1400 V.

Preferred dimensions of the focusing lens shown in FIG. 10 will now be exemplified. The electrode 24 has an inner diameter of about 10 mm and an axial length of about 27 mm, the electrode 25 has an inner diameter of about 12 mm and an axial length of about 5 mm, and the electrode 26 has an inner diameter of about 12 mm and an axial length of about 26 mm. The height of the curved portion of the plate electrode 27 in a direction of the lens axis from the end face of the electrode 26 is about 0.5 mm, and a peak of the projection of the curved portion is positioned outside the middle between the outer and inner circumferences of the plate electrode. That is, the plate electrode 27 is curved so that the inner circumference thereof or the edge of the aperture 27*a* extends into the inside of the electrode 26. Thus, the plate electrode 27 provided with the aperture 27*a* at its central portion has the form of a curved annular ring in which the height in a direction of the lens axis increases with an increased distance from the outer circumference of the plate electrode 27 toward the center axis of the aperture 27*a* until it reaches the maximum value at 27*c*, and then decreases with a further increased distance from the outer circumference of the plate 27 until it takes the minimum value at the edge of the aperture 27*a* or the inner circumference of the plate electrode 27 which is in a level lower than the outer circumference of the plate electrode 27. A distance in a radial direction between the outer circumference of the plate electrode 27 and the inner circumference thereof or the edge of the aperture 27*a* is about 4 mm, and the diameter of the aperture 27*a* is nearly equal to 4 mm in order not to interrupt the deflected electron trajectory. That is, the diameter of the aperture 27*a* is about 33% of the inner diameter of the electrode 2*b*, and the maximum height of the curved portion is about 13% of the distance in a radial direction between the outer and inner circumferences of the plate electrode 27. The total length of the main lens portion is about 63 mm which is about 17% shorter than a typical total length (about 76 mm) of the main lens portion of the conventional image pickup tube. The means an additional advantage in that the tube length can be shortened.

For comparison, an image pickup tube provided with the present embodiment has been made identical in lateral magnification of image and angular magnification of electron beam to a conventional image pickup tube so that these image pickup tubes are equal in the spread of beam spot due to thermal energy of electrons emitted from a hot cathode. Further, the position of a deflection coil mounted around the tube having the present embodiment has been adjusted to make the spot diameter of the deflected electron beam equal to that in the conventional tube. The electron trajectory in each of these image pickup tubes has been calculated to obtain the diameter $D_c$ of circle of least confusion. FIG. 11 shows a relation between the incident angle $\alpha$ of electron beam and the diameter $D_c$ of circle of least confusion for each of these tubes. In FIG. 11, a line 93 corresponds to the inventive tube and a line 94 corresponds to the conventional tube. It is apparent from FIG. 11 that when the incident angle of the electron beam from a beam-limiting aperture 8 is 1°, the spot diameter due to spherical aberration or the diameter $D_c$ of circle of least confusion in the inventive tube is 1.3 $\mu$m which is about one-half of that (2.3 $\mu$m) in the conventional tube. Further, FIG. 12 shows a relation between a beam current and the resolution measured at the center of picture surface (the degree of amplitude modulation for a vertical stripe pattern of 400 TV lines) for the inventive tube and the conventional tube. In FIG. 12, a curve 95 corresponds to the inventive tube while a curve 96 corresponds to the conventional tube. As is seen from FIG. 12, when the beam current is set to 0.4 $\mu$A which is twice larger than an ordinary value, the degree of amplitude modulation at the center of picture surface is 52% in the inventive tube which is about 10% larger than that (47%) in the conventional tube. Effects similar to those demonstrated in FIGS. 11 and 12 have been obtained even when the electrodes 24 and 25 are electrically connected with each other to provide a unitary form.

A focusing lens according to the present invention can be used as a low spherical aberration lens in an electron gun of an image pickup tube, a cathode-ray tube or the like.

What is claimed is:

1. An electron beam focusing lens for forming an electrostatic focusing field, comprising:

a first cylindrical electrode;

a second cylindrical electrode, an electric potential applied to said second cylindrical electrode being lower than an electric potential applied to said first cylindrical electrode; and a plate electrode having an aperture therein and provided at an end face of said first cylindrical electrode opposite to said second cylindrical electrode said plate electrode having a circularly curved portion which is projected toward said second cylindrical electrode between the outer circumference of said plate electrode and the inner circumference thereof defining said aperture, said aperture of said plate electrode having its diameter equal to or less than eight-tenths of the inner diameter of said first cylindrical electrode, and the maximum projection length of said curved portion of said plate electrode in a direction of the lens axis being equal to or less than one-half of a difference between the outer and inner circumference of said plate electrode in its radial direction.

2. An electron beam focusing lens according to claim 1, wherein a peak of the projection of said curved portion of said plate electrode is positioned substantially at the middle between the outer and inner circumferences of said plate electrode.

3. An electron beam focusing lens according to claim 1, wherein said second cylindrical electrode has the maximum inner diameter at an end face thereof opposite to said first cylindrical electrode.

4. An electron beam focusing lens according to claim 1, wherein a peak of the projection of said curved portion of said plate electrode is positioned outside the middle between the outer and inner circumferences of said plate electrode while the inner circumference of said plate electrode extends into said first cylindrical electrode.

5. An electron beam focusing lens according to claim 1, wherein said plate electrode has the form of an annular ring formed in such a manner that a circular arc which is convex toward said second cylindrical electrode between the outer and inner circumferences of said plate electrode is rotated about a center axis of said aperture.

6. An electron beam focusing lens according to claim 1, wherein said plate electrode has the curved portion thereof projecting beyond the end face of said first cylindrical electrode.

7. An electron beam focusing lens according to claim 6, wherein the inner circumference of said plate electrode extends into said first cylindrical electrode.

8. An electron beam focusing lens according to claim 6, wherein the inner circumference of said plate electrode terminates at a position beyond the interior of said first cylindrical electrode.

9. An electron beam focusing lens according to claim 5, wherein said plate electrode has the curved portion thereof projecting beyond the end face of said first cylindrical electrode.

* * * * *